United States Patent [19]

Nickel et al.

[11] Patent Number: 4,990,267

[45] Date of Patent: Feb. 5, 1991

[54] ANHYDROUS PREPARATION FOR FINISHING SEWING YARN AND THREAD:CONTAINS DIMETHYL-POLYSILOXANE

[75] Inventors: Friedhelm Nickel, Bremen; Sylvia Rodenwald, both of Bremen; Hans Rott, Oyten, all of Fed. Rep. of Germany

[73] Assignee: Hansa Textilchemie GmbH, Oyten, Fed. Rep. of Germany

[21] Appl. No.: 339,716

[22] Filed: Apr. 18, 1989

[30] Foreign Application Priority Data

May 5, 1988 [DE] Fed. Rep. of Germany ..... 3815231

[51] Int. Cl.[5] ..... D06M 13/20; D06M 15/64; C10M 107/50; C10M 129/40

[52] U.S. Cl. ..... 252/8.8; 8/133; 106/271; 252/8.6

[58] Field of Search ..... 252/8.8; 8/133

[56] References Cited

U.S. PATENT DOCUMENTS 4,246,423 1/1981 Martin ..... 106/287.11
4,423,092 12/1983 Huhn et al. ..... 252/8.8
4,434,008 2/1984 Dumm et al. ..... 106/271
4,496,631 1/1985 Adachi et al. ..... 8/115.6

FOREIGN PATENT DOCUMENTS 60-181368 9/1985 Japan .

*Primary Examiner*—A. Lionel Clingman
*Attorney, Agent, or Firm*—Toren, McGeady & Associates

[57] ABSTRACT

An anhydrous preparation for finishing sewing yarn and sewing thread is disclosed. The preparation essentially consists of 65 to 99% by weight of a dimethylpolysiloxane with a viscosity of 50 to 10,000 $mm^2/S^{-1}$ at 25° C. and a hydroxyl content of 0.3 to 1.5% by weight and 1 to 30% by weight of a fatty acid or a fatty amine with, on the average, 8 to 18 carbon atoms and, optionally, 0 to 5% by weight of conventional additives.

The preparation are easy to prepare and have an unlimited shelf life and a constant viscosity even over a prolonged period of storage. The preparation confer low thread tension, decreased yarn breakage and improved stick-slip properties on the sewing yarn and thread.

8 Claims, No Drawings

ANHYDROUS PREPARATION FOR FINISHING SEWING YARN AND THREAD:CONTAINS DIMETHYL-POLYSILOXANE

FIELD OF INVENTION

The invention is directed to an anhydrous preparation containing organopolysiloxanes for finishing sewing yarn and thread.

BACKGROUND INFORMATION AND PRIOR ART

It has previously been proposed to use preparations containing organopolysiloxanes as lubricants for finishing sewing yarn and sewing thread to improve their sliding or slip properties. In general, organopolysiloxanes are used for this purpose in admixture with other substances, since the usual linear dimethylpolysiloxanes by themselves do not have adequate properties for sewing purposes. More particularly, the load-bearing capacity of the organopolysiloxanes is too low. The anti-electrostatic properties are also not satisfactory. The organopolysiloxanes are therefore mixed with other active ingredients to improve the properties of such preparations.

Mixtures with other lubricant or slip-improving components, such as waxes, antistatic agents and anticorrosive agents, because of the limited miscibility of these compounds with organopolysiloxanes, are stable for only a short time or must be used in the form of aqueous preparations, such as emulsions.

However, when finishing the yarn or thread in open galettes, such aqueous preparations rapidly lose water by evaporation. At the same time, there is a build-up of active ingredients on parts of the apparatus, which leads to heavy contamination and thus to uneven add-ons of the finish. Such aqueous preparations have the additional disadvantage of higher corrosiveness. Typical of this state of the art is, for example, the European Patent No. 0 056 095. It relates to a material for increasing the sliding ability of organic fibers. This material comprises at least one organosilicon compound, which contains at least one $OSiR_2$ unit, in which R is the same or different and represents optionally substituted hydrocarbon groups with 1 to 10 carbon atoms and at least one grouping $$-X_aArX_aAr-$$

per molecule, in which X represents the same or different members of the group $$-\overset{O}{\overset{\|}{C}}-,\ -NR'-,\ -O-,\ -S-,\ -SO_2-,\ -R''-,\ -NR'R''-,\ -\overset{O}{\overset{\|}{C}}R''-,\ -OR''-,\ -SR''-,\ -SO_2R''-$$

wherein R' is hydrogen or has the same meaning as R and R'' is a divalent aliphatic hydrocarbon group with 1 to 8 carbon atoms, Ar are the same or different, bivalent, optionally substituted, aromatic hydrocarbon groups and the subscript a is 0 or 1, at least one phosphorus compound, which confers electrostatic charge dissipating properties, and optionally other materials, including paraffin wax. The material is characterized in that it contains at least one compound of the formula $$O=P[OCHR^1CHR^1)_nOR^2]_3$$

in which R' is hydrogen or the methyl group, with the proviso that in each $-OCHR^1CHR^1-$ unit, at least one $R^1$ is hydrogen, $R^2$ is hydrogen or a monovalent hydrocarbon group with 1 to 20 carbon atoms and n is 0 or a whole number from 1 to 15, with the proviso that n is at least 1, if $R^2$ is hydrogen and that there is at least one $-OCHR^1CHR^1-$ unit in each phosphorus compound.

However, these materials endow the yarns and threads with insufficient sliding or slip ability, so that the yarn tension values are too high. This is also shown by the so-called stick-slip test. For this test, the yarn is pulled off over the yarn guiding and braking organs of a sewing machine at a given yarn tension and pull-off speed and the amplitude of the yarn tension is measured. In effective preparations, this amplitude should be as small as possible.

European Patent No. 0 063 311 is named as being representative of aqueous preparations. In this patent, a material containing silicone oil and wax in the form of an oil/water dispersion is described for the substantive finishing of yarns and threads. The material contains dissolved or dispersed in water (a) 5 to 80% by weight of a silicone oil with a viscosity of 500 to 50,000 $mm^2$/sec. at 25° C., (b) 10 to 80% by weight wax with a melting point ≧40° C., (c) 1 to 10% by weight fatty acids with 6 to 22 carbon atoms, which may be saturated, branched or substituted or have double bonds, (d) 0.4 to 12% by weight of cationic imidazolinium salts, (e) 0 to 10% by weight ethoxylated fatty amines.

The sum of components (a) to (e) must be 100% by weight.

OBJECT OF THE INVENTION

It is an object of the present invention to provide anhydrous preparations suitable for finishing yarns and threads which are simple to prepare and have an unlimited shelf life. The viscosity of the preparations shall also remain constant over a prolonged period of storage. As far as possible, the preparations shall not act corrosively. Their properties, from a sewing point of view, shall at least be comparable with those of aqueous lubricant formulations.

SUMMARY OF THE INVENTION

Surprisingly, this profile of properties is found in an anhydrous preparation essentially consisting of 65 to 99% by weight of a dimethylpolysiloxane with a viscosity of 50 to 10,000 $mm^2$/sec. at 25° C. and a hydroxyl content of 0.3 to 1.5% by weight, and 1 to 30% by weight of a fatty acid or a fatty amine with an average of 8 to 18 carbon atoms and, optionally, 0 to 5% by weight of additives.

Preferably, the inventive preparation consists essentially of 90 to 99% by weight of the above dimethylpolysiloxane and 1 to 5% by weight of the above fatty acid or fatty amine, and, optionally, 0 to 5% by weight of additives.

The dimethylpolysiloxanes contained in the preparation shall have a viscosity of 50 to 10,000 $mm^2/s^{-1}$ and a hydroxyl content of 0.3 to 1.5% by weight and preferably of 0.4 to 0.8% by weight.

As a second component, the inventive preparation contains a fatty acid or a fatty amine with, on the average, 8 to 18 carbon atoms. Especially preferred are fatty acids or fatty amines with, on the average, 8 to 16 carbon atoms and particularly 10 to 14 carbon atoms. Saturated fatty acids and fatty amines are preferred. Especially suitable is hydrogenated (hardened) coconut fatty acid or hydrogenated coconut fatty amine. Mixtures of natural fatty acids or mixtures of fatty amines are generally to be preferred. As $C_{18}$ fatty acid, isostearic acid is to be preferred to stearic acid because of its better compatibility. With regard to the sewing properties, however, stearic acid behaves better. The solubility of the fatty acid or the fatty amine decreases as the number of carbon atoms increases. Since the solubility of these compounds in organopolysiloxanes improves with increasing temperature, it is advisable to use inventive preparations which contain a fatty acid or a fatty amine with 16 or more carbon atoms, at elevated temperatures, such as a temperature of 40° to 50° C., as a so-called hot melt.

If desired, the inventive preparation may contain usual additives as well, such as ester oils or organic phosphate. Examples of suitable ester oils are trimethylolpropane or pentaerythritol esters of pelargonic acid and fatty esters of lower alcohols, such as butyl stearate.

Examples of suitable phosphates are the esters or partial esters of phosphoric acid with aliphatic alcohols with 1 to 20 carbon atoms, as well as the phosphate esters of alkoxylated, especially ethoxylated aliphatic alcohols and alkylphenols, especially nonylphenol.

The inventive preparations are produced by simple mixing, if necessary at an elevated temperature. In the following examples, different inventive preparations are compared with products of the state of the art from the point of view of their sewing properties.

To begin with, 5 preparations are produced, the compositions of which are given in the following Table.

TABLE I

| Component A/B | Preparation 1 | 2 | 3 | 4 | 5 |
|---|---|---|---|---|---|
| Dimethylpolysiloxane | Parts by Weight | | | | |
| 150 mm²/sec. and 0.7% OH content | 100 | 95 | — | — | — |
| 400 mm²/sec. and 0.6% OH content | — | — | 95 | — | — |
| 1000 mm²/sec. and 0.35% OH content | — | — | — | 95 | — |
| trimethylsilyl terminated | — | — | — | — | 100 |
| 350 mm²/sec. and 0% OH content | | | | | |
| i-stearic acid | — | 5 | — | — | — |
| coconut fatty amine, hydrogenated | — | — | 4 | — | — |
| coconut fatty acid, hydrogenated | — | — | — | 5 | — |
| mono/di-tert-butyl phosphate | — | — | 1 | — | — |

The individual components of the preparations are mixed at a temperature of 45° C. and stirred until a clear solution is formed. The preparations are then cooled to room temperature. Preparations 6 and 7 are used for comparison.

PREPARATION 6

A dimethylpolysiloxane (35 parts by weight), which has trimethylsilyl end groups, no hydroxyl groups and a viscosity of 1000 mm²/sec. is mixed with 10 parts by weight of a paraffin wax with a melting point of 52° to 54° C. and heated to 90° C. In the melt obtained, 3 g of an ethoxylated coconut fatty amine with an HLB value of 12 is dispersed as emulsifier. Hot water (90° C., 53 parts by weight) is stirred into the oily phase obtained. The emulsion obtained is allowed to cool with slow stirring.

PREPARATION 7

Preparation 7 corresponds to the preparation of Example 2 of the European Patent No. 0 056 095.

Testing the Application

For the experiments, a polyester (PES) triple thread (NXm 100/3), made from stretch-broken tow cable, was finished with the preparation on a galette.

(A) Add-on in %

The add-on of the preparation on the thread was determined by weighing treated and untreated sewing yarn and calculating the difference.

(B) Thread Tension

The thread tension was determined with a thread tension measuring instrument, type DXX, of Schmidt & Co. KG, Waldkraiburg.

(C) Sewing Test

With the treated test thread (as upper thread), 12, 14 or 16 layers of a cotton cretonne are sewn three times at maximum sewing speed until the thread tears. The thickness of the needle used depends on the denier of the test thread. In practice, the tests set forth below were carried out with a polyester triple thread Nm 100/3 having a denier of about 300, using a needle obtained from the Shmetz Company with a thickness of Nm 90/14, System 134 (R), by means of a Duerkopp industrial sewing machine having a maximum speed of the order of 3,600 stitches/minute.

If, on the average, a sewing distance of more than 40 cm is attained, the test is repeated with the number of layers increased by two. If the average sewing distance attained is less than 10 cm, the test is repeated with the number of layers decreased by two.

The result is given as the average sewing distance attained in cm, the thickness of the needle used being stated.

(D) Stick-Slip

Stick-slip is measured according to the following procedure:

Experimental Apparatus

An industrial sewing machine, Rothschild F-Meter and off-take instrument with 400 g measuring head, recorder are used. The sewing machine is provided with a smoothing device for the test thread, thread pull-off spring, thread tensioning device, thread guide hoop and thread delivery tube, from which the thread is led to the off-take instrument which is supplied with guide pulleys and the measuring head.

Procedure

Before the start of each measurement, all thread guides and brakes and the measurement head must be cleaned carefully with ethanol. Subsequently, the Rothshild instrument is calibrated as follows:

(a) Turn on instrument; since the instrument takes at least 1 hour to warm up, it is advisable to keep the F meter switched on at all times.

(b) Adjust zero points $t_1$ and $t_2$.

(c) Set mode switches to F and calibration.

(d) Suspend calibrating weight from measuring head $t_1$, taking care that the thread touches the friction body and the lower guide pin. With the calibrating knob, set the calibration value $t_1$ corresponding to the weight.

(e) Check for agreement between F meter reading and recorder; if necessary, make a correction.

For the measurement, and with the mode switch at "measure $t_1$", the calibrating thread (GÜtermann T 353) is pulled off from the reel over the thread guiding and braking organs of a sewing machine and over the measuring head $t_1$ at a rate of 6 m/min. The yarn tension is set to 130 g by adjusting the yarn brake.

After the yarn guides and brake and the measuring head are cleaned once again with ethanol, the test thread is pulled off over the same arrangement at a rate of 2, 6 or 14 m/min and the thread tension $t_1$ is measured by the recorder.

The recorder trace is evaluated with respect to the average difference between the minimum and maximum values of the thread tension, the stick-slip behavior being evaluated in accordance with the following Table:

TABLE II

| Grade | Amplitude of the Thread Tension Tensograph |
|---|---|
| 1 | 0–2 mm |
| 2 | 2–5 mm |
| 3 | 5–9 mm |
| 4 | 9–13 mm |
| 5 | 13–18 mm |
| 6 | >18 mm |

TABLE III

| Preparation | Add-on (%) | Thread Tension (g) | Sewing Test (cm) | Stick-Slip |
|---|---|---|---|---|
| 1 Not of the Invention | 4.6 | 200–250 | 21 | 5–6 |
| 2 Of the Invention | 4.8 | 140–150 | 24 | 2 |
| 3 Of the Invention | 4.8 | 140–145 | 26 | 1–2 |
| 4 Of the Invention | 4.5 | 135–140 | 28 | 1 |
| 5 Not of the Invention | 5.0 | 130–150 | 18 | 3–4 |
| 6 Not of the Invention | 4.7 | 140–150 | 22 | 2 |

TABLE III-continued

| Preparation | Add-on (%) | Thread Tension (g) | Sewing Test (cm) | Stick-Slip |
|---|---|---|---|---|
| 7 Not of the Invention | 4.9 | 160–170 | 23 | 2–3 |

It can be seen from Table III that the inventive preparation produce a low thread tension, decreased yarn breakage and improved stick-slip behavior.

We claim:

1. An anhydrous preparation containing organopolysiloxanes suitable for finishing sewing yarn and thread, said preparation essentially comprising 90 to 99% by weight of a dimethylpolysiloxane with a viscosity of 50 to 10,000 $mm^2$/sec. at 25° C. and a hydroxyl content of 0.3 to 1.5% by weight and 1 to 30% by weight of a fatty acid or a fatty amine with, on the average, 8 to 18 carbon atoms.

2. A preparation as claimed in claim 1, essentially consisting of 90 to 99% by weight of said dimethylpolysiloxane and 1 to 5% by weight of said fatty acid or fatty amine.

3. A preparation as claimed in claim 1, wherein the dimethylpolysiloxane has a hydroxyl content of 0.4 to 0.8% by weight.

4. A preparation as claimed in claim 2, wherein the dimethylpolsiloxane has a hydroxyl content of 0.4 to 0.8% by weight.

5. A preparation as claimed in claim 1 or 2, further comprising not more than 0.5% by weight of conventional additives.

6. The preparation as claimed in claim 1 or 2, further comprising not more than 0.5% by weight of an additive which is an ester oil or an organic phosphate, wherein the ester oil is a member of the group consisting of a trimethylolpropane ester of pelargonic acid, a pentaerythritol ester of pelargonic acid and a fatty ester of a lower alcohol and the organic phosphate is a member of the group consisting of an ester or partial ester of phosphoric acid and an aliphatic alcohol having 1 to 20 carbon atoms, a phosphate ester of an alkoxylated aliphatic alcohol and a phosphate ester of an alkylphenol.

7. Sewing yarn or thread having a finishing layer of the preparation of claim 1.

8. Sewing yarn or thread having a finishing layer of the preparation of claim 2.

* * * * *